US012805596B2

(12) United States Patent
Newton et al.

(10) Patent No.: US 12,805,596 B2
(45) Date of Patent: Nov. 24, 2026

(54) VACUUM RELEASE MECHANISM FOR A FOOTWEAR ARTICLE

(71) Applicant: SWAMP STOMPERS, LLC, Miami, FL (US)

(72) Inventors: Thomas Wayne Newton, Miami, FL (US); Lisa Fitzgerald, Leesburg, FL (US)

(73) Assignee: SWAMP STOMPERS, LLC, Miami, FL (US)

( * ) Notice: Subject to any disclaimer, the term of this patent is extended or adjusted under 35 U.S.C. 154(b) by 0 days.

(21) Appl. No.: 19/360,163

(22) Filed: Oct. 16, 2025

(65) Prior Publication Data

US 2026/0041191 A1 Feb. 12, 2026

Related U.S. Application Data

(63) Continuation-in-part of application No. 18/659,543, filed on May 9, 2024, now Pat. No. 12,465,112.

(51) Int. Cl.
*A43B 7/08* (2022.01)
*A43B 3/02* (2006.01)
(Continued)

(52) U.S. Cl.
CPC ..... *A43B 7/083* (2022.01); *A43B 3/02* (2013.01); *A43B 7/081* (2013.01); *A43B 7/087* (2013.01); *A43B 7/12* (2013.01); *A43B 11/00* (2013.01)

(58) Field of Classification Search
CPC .. A43B 7/06; A43B 7/08; A43B 7/082; A43B 7/083; A43B 7/084; A43B 7/087; A43B 7/088; A43B 7/12
See application file for complete search history.

(56) References Cited

U.S. PATENT DOCUMENTS 1,069,001 A * 7/1913 Guy ..... A43B 13/206 36/29
2,402,334 A 6/1946 Marks
(Continued)

FOREIGN PATENT DOCUMENTS

CN 2227429 Y 5/1996
CN 101862047 A 10/2010

OTHER PUBLICATIONS

Non-Final Office Action dated Jun. 21, 2024, issued in U.S. Appl. No. 18/659,543 (9 pages).
(Continued)

*Primary Examiner* — Sharon M Prange
(74) *Attorney, Agent, or Firm* — Shumaker, Loop & Kendrick, LLP

(57) ABSTRACT

A footwear article having a vacuum release mechanism is disclosed. The vacuum release mechanism is configured to equalize pressure and release a vacuum created beneath a sole of the footwear article. The vacuum release mechanism mitigates undesired retention of the footwear article in high-viscosity materials such as mud or concrete. The vacuum release mechanism includes at least one sleeve fixedly secured within at least one fluid passageway formed in the sole, which fluidly connects an exterior environment to an interior of the footwear article. A replaceable check valve is removably disposed within the at least one sleeve. An installation and removal tool may be used to engage and disengage the check valve from the at least one sleeve.

18 Claims, 14 Drawing Sheets

(51) Int. Cl.

| | |
|---|---|
| ***A43B 7/083*** | (2022.01) |
| ***A43B 7/12*** | (2006.01) |
| ***A43B 11/00*** | (2006.01) |

(56) References Cited

U.S. PATENT DOCUMENTS

| | | | | |
|---|---|---|---|---|
| 2,548,753 | A | 4/1951 | Gustaf | |
| 2,708,320 | A | 5/1955 | Hilton | |
| 3,339,298 | A | 9/1967 | Kesselman | |
| 4,771,555 | A * | 9/1988 | Ohashi | A43B 5/04 36/3 R |
| 4,888,887 | A | 12/1989 | Solow | |
| 5,375,345 | A | 12/1994 | Djuric | |
| 2004/0163278 | A1 | 8/2004 | Caspers et al. | |
| 2005/0183290 | A1 | 8/2005 | Cantrell | |
| 2006/0059722 | A1 | 3/2006 | Jarriel | |
| 2009/0083995 | A1* | 4/2009 | Hsieh | A43B 7/082 36/43 |
| 2016/0058125 | A1 | 3/2016 | Martin, Sr. | |
| 2016/0192728 | A1* | 7/2016 | Crawford | A43B 3/26 36/45 |
| 2018/0199662 | A1* | 7/2018 | Meacock | A43B 7/085 |
| 2019/0365041 | A1* | 12/2019 | Weast | A43B 23/029 |
| 2023/0210217 | A1* | 7/2023 | Sherlock | A43B 3/0036 36/25 R |

OTHER PUBLICATIONS

Non-Final Office Action dated Feb. 27, 2025, issued in U.S. Appl. No. 18/659,543 (11 pages).
Final Office Action dated Oct. 22, 2024, issued in U.S. Appl. No. 18/659,543 (10 pages).

* cited by examiner

VACUUM RELEASE MECHANISM FOR A FOOTWEAR ARTICLE

CROSS REFERENCE TO RELATED APPLICATIONS

This application is a continuation-in-part of U.S. patent application Ser. No. 18/659,543 filed May 9, 2024, the entirety of which is incorporated herein by reference.

FIELD

The present invention relates generally to the field of footwear, and more particularly to a vacuum release mechanism for a footwear article such as work, hiking and military style footwear for wet service.

BACKGROUND

When wearing boots in wet areas often these conditions can create a high viscosity mixture of soil or man-made mixtures such as concrete. This can cause the boot to become extremely hard or impossible to pull out when stepping into these mixtures. This is caused by vacuum created on the sole of the boot as the user tries to lift their feet. This will cause a lack of mobility, is annoying and in some circumstances can be dangerous. A construction worker may not be able to avoid moving equipment or a soldier may not be able to find cover from gun fire in time to avoid harm.

SUMMARY

In concordance and agreement with the present disclosure, a vacuum release mechanism for a footwear article, has surprisingly been designed.

A need exists to provide footwear, for example boots, which can minimize and/or eliminate vacuum thereby preventing the footwear from becoming stuck when walking or working in high viscosity materials. The addition of one or more check valves placed in the footwear relieves this vacuum. The check valves allow higher atmospheric pressure to equalize pressure between the top of the footwear and vacuum on the sole of the footwear. This destroys the vacuum that sticks the footwear in the viscous fluid. When the footwear is worn in low viscosity areas such as water, the check valves keep water or other low viscosity liquids from entering the footwear.

The check valves may also be removable to facilitate the replacement of the check valves. This is particularly useful in situations where one of the check valves fails or is damaged, allowing the user to replace the check valve so that the vacuum release mechanism operates as intended.

In one embodiment, a vacuum release mechanism for a footwear article, comprises: at least one check valve disposed in at least one fluid passageway formed in a sole of a footwear article, wherein the at least one fluid passageway fluidly connects an exterior environment with an interior of the footwear article.

In another embodiment, a footwear article, comprises: a sole including an insole and an outsole; an upper coupled to the sole, wherein the insole and the upper defines an interior of the footwear article; and a vacuum release mechanism disposed in the sole, the vacuum release mechanism comprising: at least one check valve disposed in at least one fluid passageway formed in the sole of the footwear article, wherein the at least one fluid passageway fluidly connects an exterior environment with the interior of the footwear article.

In another embodiment, a vacuum release mechanism for a footwear article, comprises: at least one sleeve fixedly secured within at least one passageway formed in a sole of the footwear article; and at least one replaceable check valve removably disposed within the at least one sleeve.

In another embodiment, a footwear article, comprises: a sole including an insole, an outsole, and a heel; an upper coupled to the sole, wherein the insole and the upper defines an interior of the footwear article; at least one passageway formed in the sole, the at least one passageway fluidly connects an exterior environment with the interior of the footwear article; and at least one vacuum release mechanism disposed within the at least one passageway of the sole, having: at least one sleeve fixedly secured within at least one passageway formed in the sole; and at least one replaceable check valve removably disposed within the at least one sleeve.

In yet another embodiment, a footwear article, comprises: a sole including an insole, an outsole, and a heel having a side face, wherein the side face of the heel intersects and is formed at an angle relative to an outer contact surface of the outsole; an upper coupled to the sole, wherein the insole and the upper defines an interior of the footwear article; at least one passageway formed in the sole, the at least one passageway fluidly connects an exterior environment with the interior of the footwear article, wherein a first end opening of the at least one passageway is formed in the side face of the heel and a second end opening of the at least one passageway is formed in the insole; and at least one vacuum release mechanism disposed within the at least one passageway of the sole, having: at least one sleeve fixedly secured within at least one passageway formed in a sole of the footwear article; and at least one replaceable check valve removably disposed within the at least one sleeve, wherein the at least one replaceable check valve is a spring-type check valve, having: a valve body; a movable valve piston disposed within the valve body, the valve piston positionable between a closed position to militate against a flow of fluid through the at least one passageway and an open position to permit the flow of fluid through the at least one passageway; and a biasing element configured to urge the movable valve piston towards the closed position.

As aspects of some embodiments, the footwear article forms part of a waterproof garment.

As aspects of some embodiments, the at least one fluid passageway is fluidly connected to a tube having an end open to the exterior environment.

As aspects of some embodiments, an entirety of the at least one fluid passageway is formed in the sole of the footwear article.

As aspects of some embodiments, the at least one fluid passageway is formed at an angle through the sole of the footwear article.

As aspects of some embodiments, a plurality of check valves is disposed in a plurality of fluid passageways formed in the sole of the footwear article, and wherein each of the fluid passageways is separate and fluidly disconnected from one another.

As aspects of some embodiments, a plurality of check valves is disposed in a plurality of fluid passageways formed in the sole of the footwear article, and wherein at least two of the fluid passageways are fluidly connected to one another.

As aspects of some embodiments, the at least one fluid passageway forms a linear flow path through the sole of the footwear article.

As aspects of some embodiments, an end opening of the at least one fluid passageway is formed in a face of a heel of the footwear article.

As aspects of some embodiments, an end opening of the at least one fluid passageway is at an angle to an outsole of the footwear article.

As aspects of some embodiments, an end opening of the at least fluid passageway is oblique to an outsole of the footwear article.

As aspects of some embodiments, an end opening of the at least one fluid passage way is relatively coplanar with an interior surface of an insole of the footwear article.

As aspects of some embodiments, the at least one check valve in a first position militates against a flow of fluid therethrough when the footwear article is unrestrained, and wherein the at least one check valve in a second position permits the flow of fluid therethrough when the footwear article is restrained by a vacuum.

As aspects of some embodiments, the at least one check valve is one of a piston-type check valve, a ball-type check valve, a diaphragm-type check valve, a swing-type check valve, a spring-type check valve, and a duckbill-type check valve.

As aspects of some embodiments, the at least one check valve is retained in the at least one fluid passageway by one of an interference fit, a threaded engagement, and at least one retaining element.

As aspects of some embodiments, a substantially fluid tight seal is formed between the at least one check valve and an inner surface of the at least one fluid passageway.

As aspects of some embodiments, the sole of the footwear article is produced from a self-sealing material that forms a substantially fluid-tight seal between the at least one check valve and an inner surface of the at least one fluid passageway.

As aspects of some embodiments, the vacuum release mechanism further comprises a sealing element to form a substantially fluid-tight seal between the at least one check valve and an inner surface of the at least one fluid passageway.

As aspects of some embodiments, the check valve is replaceable.

As aspects of some embodiments, the at least one replaceable check valve is a spring-type check valve, having: a valve body; a movable valve piston disposed within the valve body, the valve piston positionable between a closed position to militate against a flow of fluid through the at least one passageway and an open position to permit the flow of fluid through the at least one passageway; and a biasing element configured to urge the movable valve piston towards the closed position.

As aspects of some embodiments, an outer surface of the at least one sleeve includes one or more projections formed thereon and configured to engage an inner surface of the at least one passageway.

As aspects of some embodiments, the at least one replaceable check valve is releasably coupled to the at least one sleeve by threaded engagement.

As aspects of some embodiments, the valve body is configured to cooperate with a tool for installation and removal from the at least one sleeve.

As aspects of some embodiments, the valve body includes one or more slots configured to cooperate with one or more teeth of a tool for installation and removal from the at least one sleeve.

As aspects of some embodiments, a side face of the heel intersects and is formed at an angle relative to an outer contact surface of the outsole, and wherein a first end opening of the at least one passageway is formed in the side face of the heel and a second end opening of the at least one passageway is formed in the insole.

As aspects of some embodiments, the first end opening of the at least one fluid passageway is oblique to the outsole of the footwear article.

As aspects of some embodiments, the second end opening of the at least one fluid passageway is relatively coplanar with an interior surface of the insole of the footwear article.

As aspects of some embodiments, the at least one check valve is maintained in the closed position when the footwear article is not subjected to a vacuum force, and wherein the at least one check valve transitions to the open position when the vacuum force acting on the at least one check valve exceeds a biasing force exerted by the biasing element on the movable valve piston so that the flow of fluid through the at least one passageway is permitted when the footwear article is restrained by a vacuum.

As aspects of some embodiments, a plurality of vacuum release mechanisms is disposed in a plurality of fluid passageways formed in the sole of the footwear article, and wherein each of the fluid passageways is separate and fluidly disconnected from one another.

As aspects of some embodiments, the sole of the footwear article is produced from a self-sealing material that forms a substantially fluid-tight seal between the at least one sleeve and an inner surface of the at least one fluid passageway.

As aspects of some embodiments, a sealing element to form a substantially fluid-tight seal between the at least one sleeve and an inner surface of the at least one fluid passageway.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

DETAILED DESCRIPTION

Figure 1:
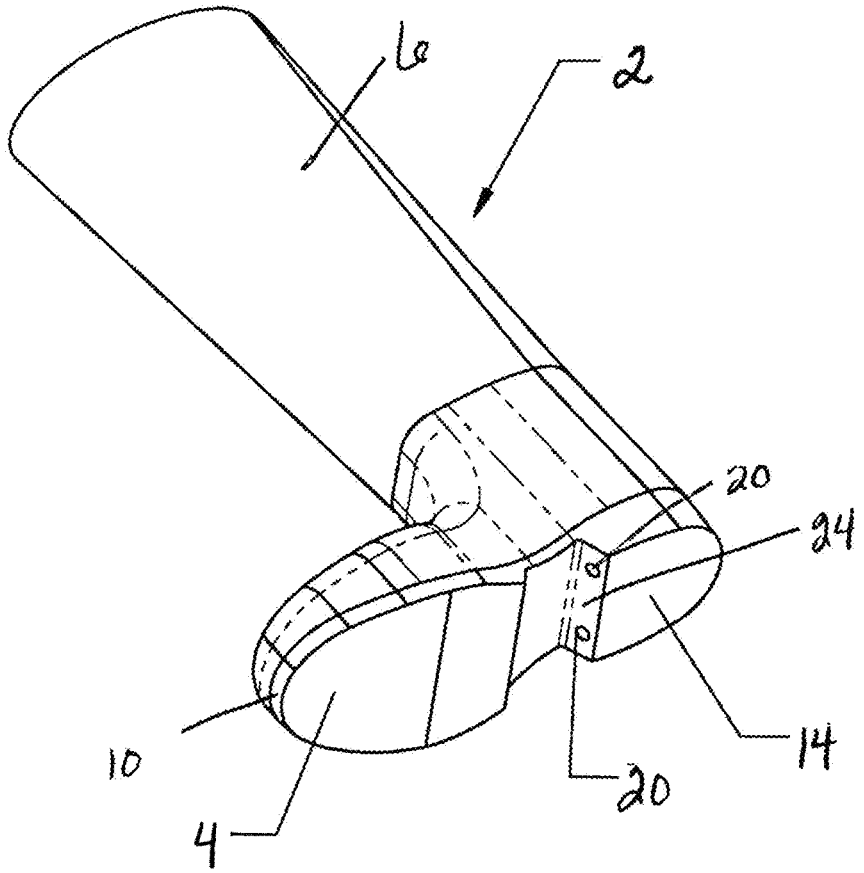
FIG. 1 is a side perspective view of a footwear article having a vacuum release mechanism according to an embodiment of the present disclosure.
Figure 2:
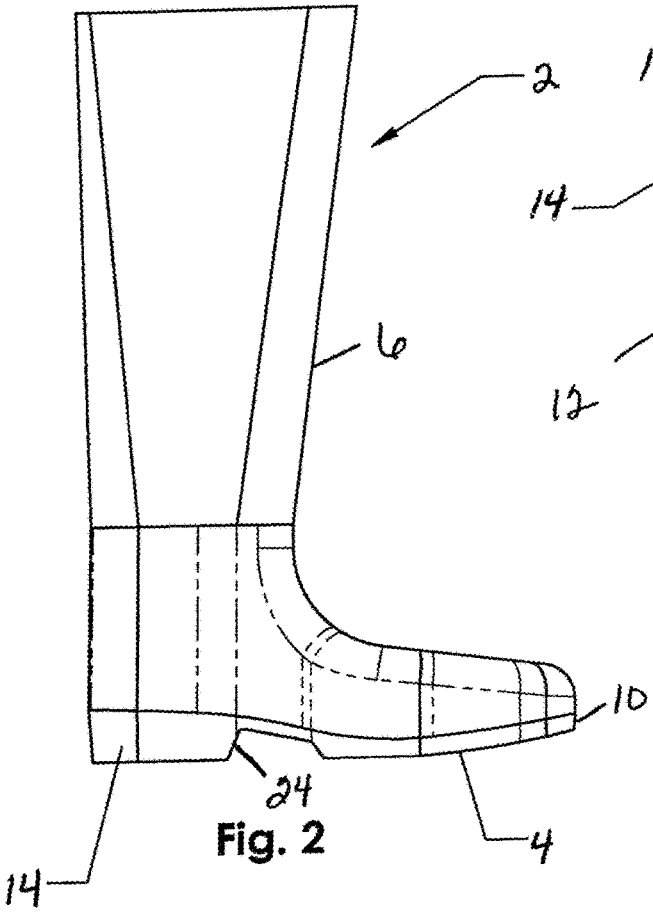
FIG. 2 is a side elevational view of the footwear article of FIG. 1.
Figure 4:
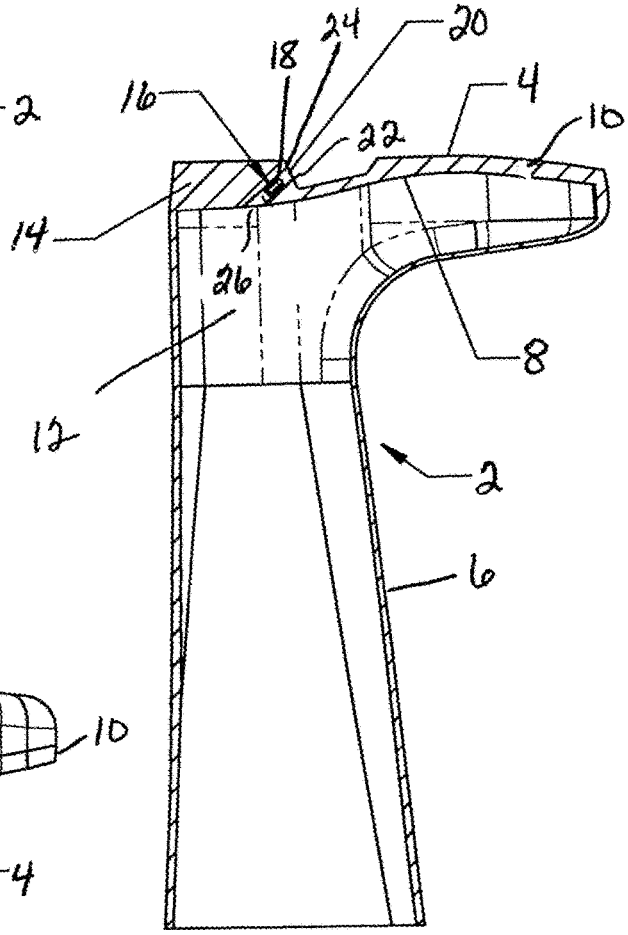
FIG. 4 is a section view of the footwear article of FIGS. 1-3 taken along section line 4-4 of FIG. 3.

The following description of technology is merely exemplary in nature of the subject matter, manufacture and use of one or more disclosures, and is not intended to limit the scope, application, or uses of any specific disclosure claimed in this application or in such other applications as may be filed claiming priority to this application, or patents issuing therefrom. Regarding methods disclosed, the order of the steps presented is exemplary in nature, and thus, the order of the steps can be different in various embodiments. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

All documents, including patents, patent applications, and scientific literature cited in this detailed description are incorporated herein by reference, unless otherwise expressly indicated. Where any conflict or ambiguity may exist between a document incorporated by reference and this detailed description, the present detailed description controls.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, all compositional percentages are by weight of the total composition, unless otherwise specified. Disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

FIGS. 1-11 illustrate a vacuum release mechanism for a footwear article 2 according to an embodiment of the present disclosure. Typically, the footwear article 2 includes a sole 4 and an upper 6 coupled to the sole 4. It is understood that the sole 4 and the upper 6 may be separate and distinct components of the footwear article 2 or be integrally formed as a single unit. The sole 4 may comprise an insole 8 and an outsole 10. The upper 6 and the insole 8 may define an interior 12 of the footwear article 2. A heel 14 may also be formed on a rear portion of the sole 4 of the footwear article 2. It is understood that the heel 14 may be integrally formed with and become a part of the sole 4 of the footwear article 2. In some embodiments, the footwear article 2 may be a shoe, a boot, or any type of footwear that may be worn in high-viscosity material. In other embodiments, the footwear article 2 may also form part of a waterproof garment such as waders, for example.

As illustrated, the footwear article 2 may further include a vacuum release mechanism 16. The vacuum release mechanism 16 may include one or more check valves 18 disposed in one or more fluid passageways 20 formed in the sole 4 and/or the heel 14 of the footwear article 2. An entirety of the fluid passageways 20 may be formed in the sole 4 and/or heel 14 of the footwear article 2. In some embodiments, the fluid passageways 20 may be formed at an angle through the sole 4 and/or the heel 14. The fluid passageways 20 form flow paths through the sole 4 and/or heel 14 of the footwear article 2 and fluidly connect the interior 12 of the footwear article 2 to an exterior environment. Although the flow paths depicted are generally linear flow paths, it is understood that each of the flow paths formed by the fluid passageways 20 may have any shape, size, and configuration as desired.

Figure 3:
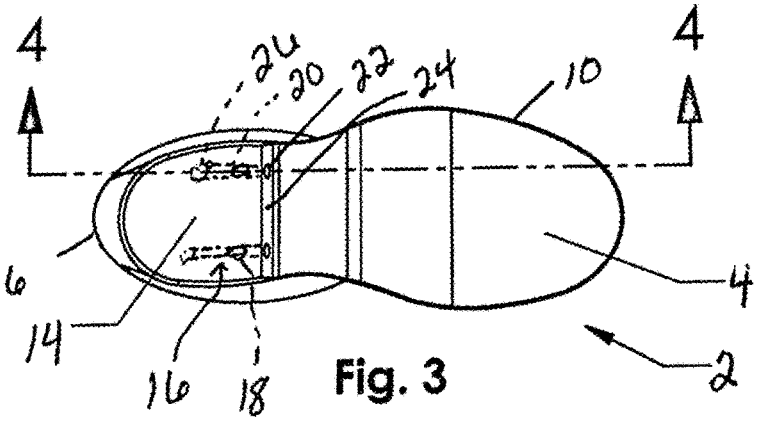
FIG. 3 is a bottom plan view of the footwear article of FIGS. 1 and 2.
Figure 5:
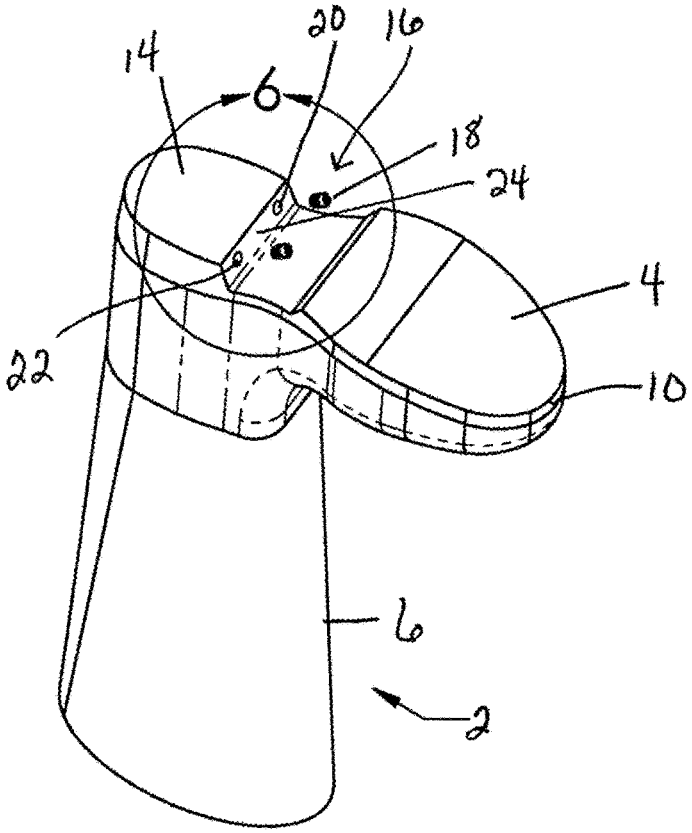
FIG. 5 is a partially exploded bottom perspective view of the footwear article of FIGS. 1-4.
Figure 6:
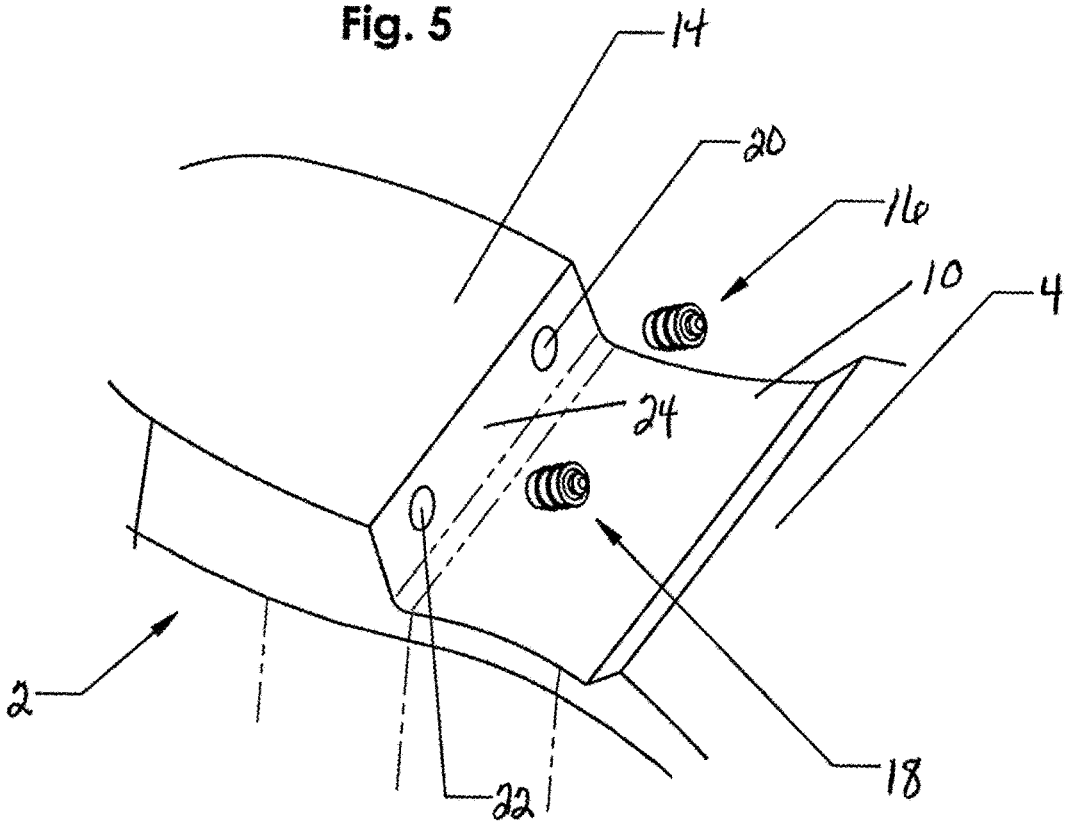
FIG. 6 is a partially exploded enlarged detailed view of a portion of the footwear article of FIGS. 1-5 depicted within Circle Area 6 of FIG. 5.
Figure 7:
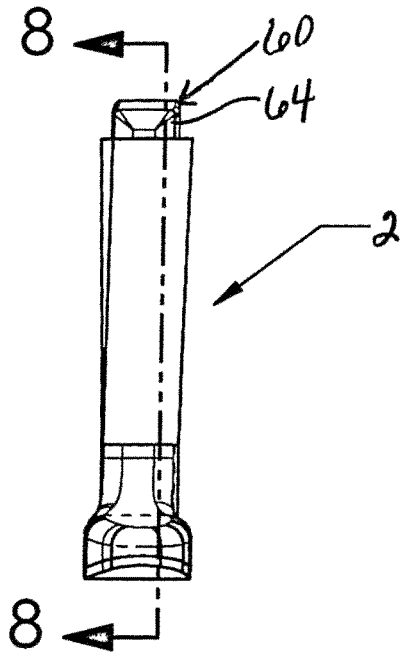
FIG. 7 is a fragmentary front elevational view of the footwear article of FIGS. 1-6, wherein a lower limb portion of a wearer is disposed in the footwear article and the lower limb portion is in a first position.
Figure 8:
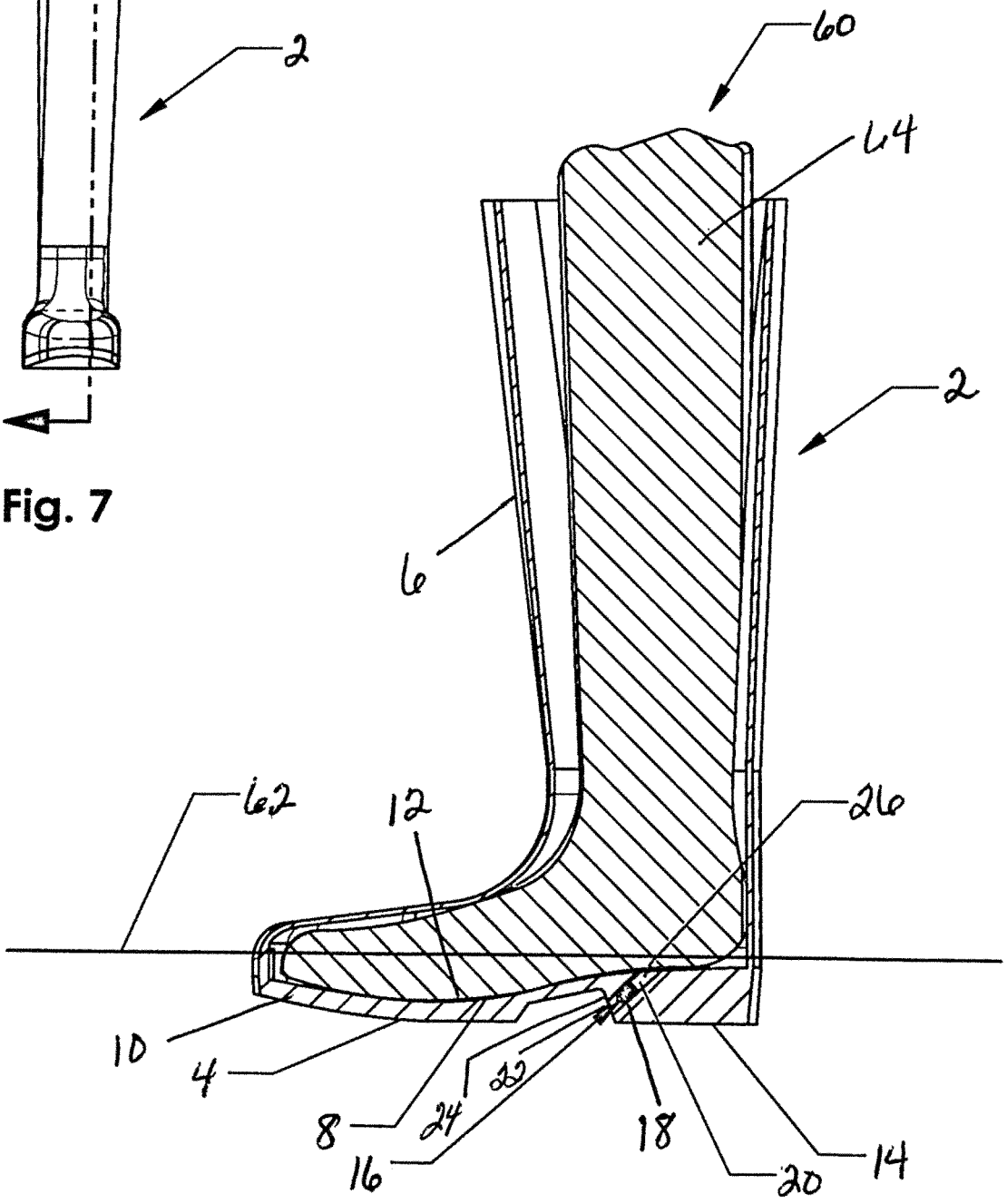
FIG. 8 is a fragmentary section view of the footwear article of FIGS. 1-7 taken along section line 8-8 of FIG. 7, wherein the lower limb portion of the wearer is disposed in the footwear article and the lower limb portion is in the first position.
Figure 9:
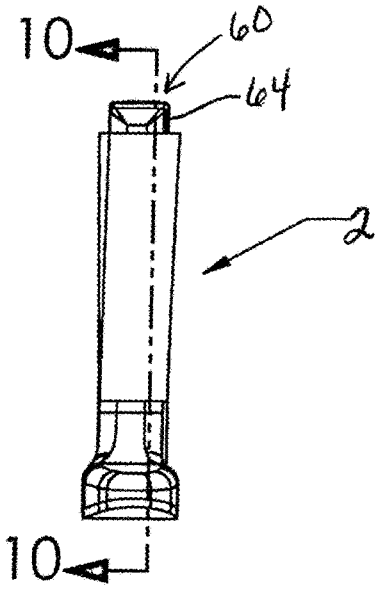
FIG. 9 is a fragmentary front elevational view of the footwear article of FIGS. 1-8, wherein a lower limb portion of a wearer is disposed in the footwear article and the lower limb portion is in a second position.
Figure 11:
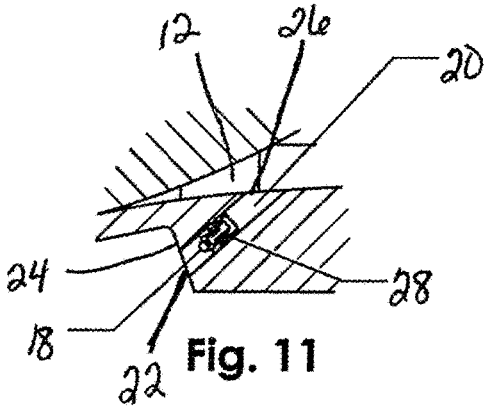
FIG. 11 is an enlarged detailed view of a portion of the footwear article of FIGS. 1-10 depicted within Circle Area 11 of FIG. 10.

Each of the fluid passageways 20 may be separate and fluidly disconnected from one another as more clearly shown in FIG. 3. It is understood, however, that in certain embodiments, at least two of the fluid passageways 20 may be fluidly connected within the sole 4 and/or the heel 14 of the footwear article 2. End openings 22 of the fluid passageways 20 may be formed in a face 24 of the heel 14 of the footwear article 2. Such location is advantageous to keep the end openings 22, the check valves 18, and the fluid passageways 20 free of undesired material and debris that may cause blockage thereof. In certain embodiments, the end openings 22 may be formed at an angle to the outsole 10 of the footwear article 2, and more particularly, the end openings 22 may be oblique to the outsole 10. Opposing end openings 26 of the fluid passageways 20 may be relatively coplanar with an interior surface of the insole 8 of the footwear article 2. In some embodiments, the fluid passageways 20, and more particularly the end openings 26 thereof, may be fluidly connected to a tube having an end open to the exterior environment.

In the embodiment shown in FIGS. 6-11, each of the check valves 18 may be disposed into a respective one of the fluid passageways 20. The check valves 18 may be retained in the fluid passageways 20 by one of an interference fit, a threaded engagement, and at least one retaining element. It is understood that the check valves 18 may be any type of check valves as desired such as a piston-type check valve, a ball-type check valve, a diaphragm-type check valve, a swing-type check valve, a spring-type check valve, and a duckbill-type check valve, for example. The check valves 18 may be replaceable if desired. A substantially fluid tight seal is formed between the check valves 18 and an inner surface 28 of the fluid passageways 20. In some embodiments, the sole 4 and/or heel 14 of the footwear article 2 is produced from a self-sealing material (e.g., rubber, silicone) that forms a substantially fluid-tight seal between the check valves 18 and the inner surface 28 of the fluid passageways 20. In other embodiments, a sealing element may be disposed between the check valves 18 and the inner surface 28 of the fluid passageways 20 to form a substantially fluid-tight seal therebetween.

Figure 14:
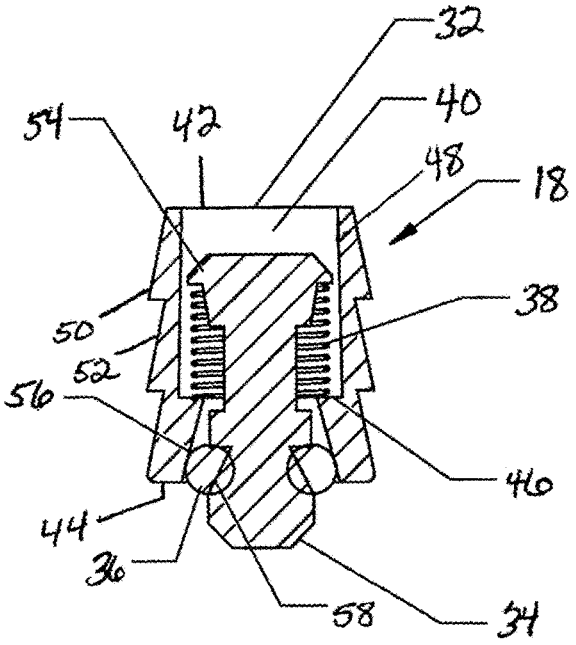
FIG. 14 is a cross-sectional view of the check valve of FIGS. 12 and 13 taken along section line 14-14 of FIG. 13, wherein the check valve is depicted in a closed or first position.
Figure 15:
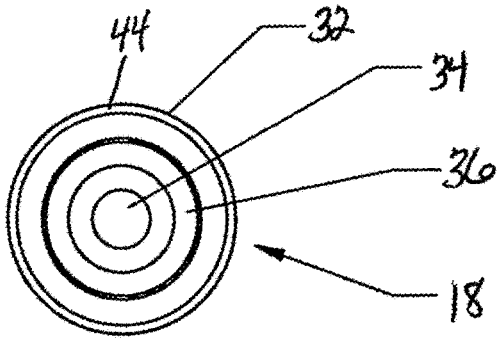
FIG. 15 is a bottom plan view of the check valve of FIGS. 12-14.
Figure 16:
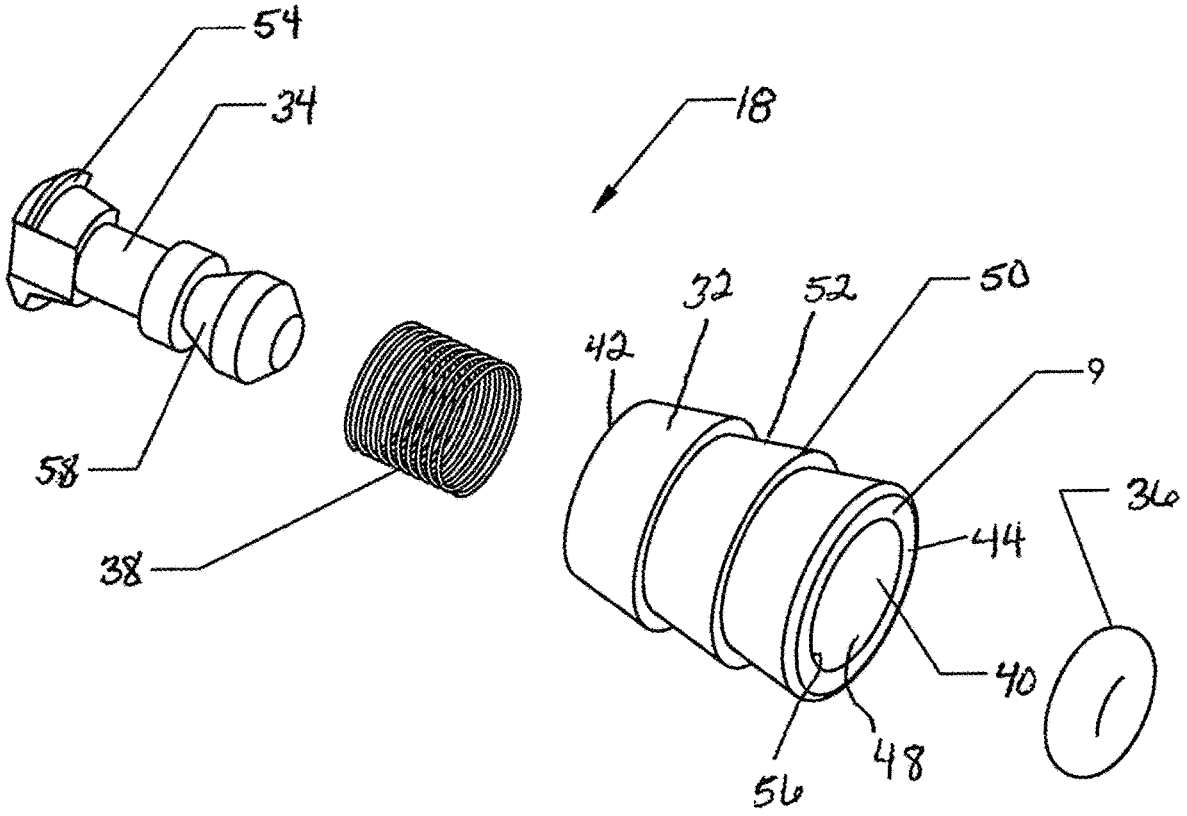
FIG. 16 is an exploded side perspective view of the check valve of FIGS. 12-15.
Figure 17:
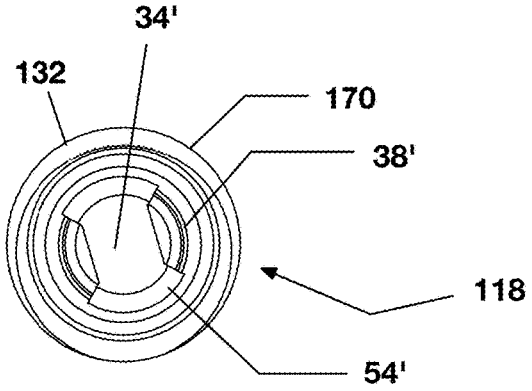
FIG. 17 is a top plan view of a check valve of another exemplary embodiment of a vacuum release mechanism for the footwear article of FIGS. 1-11.
Figure 19:
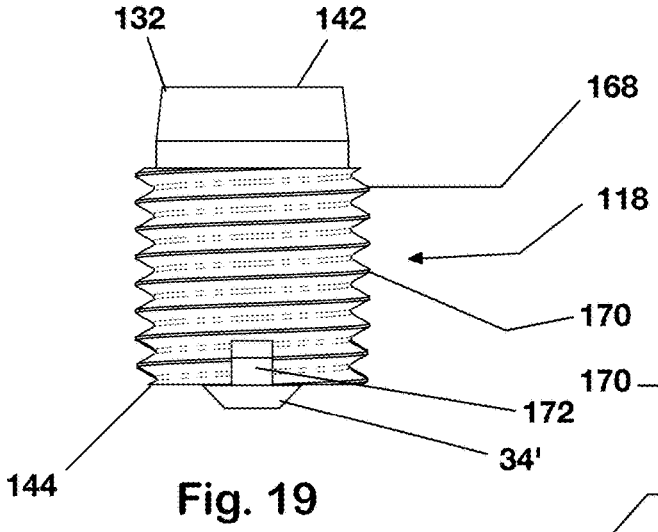
FIG. 19 is a side elevational view of the check valve of FIGS. 17-18.
Figure 18:
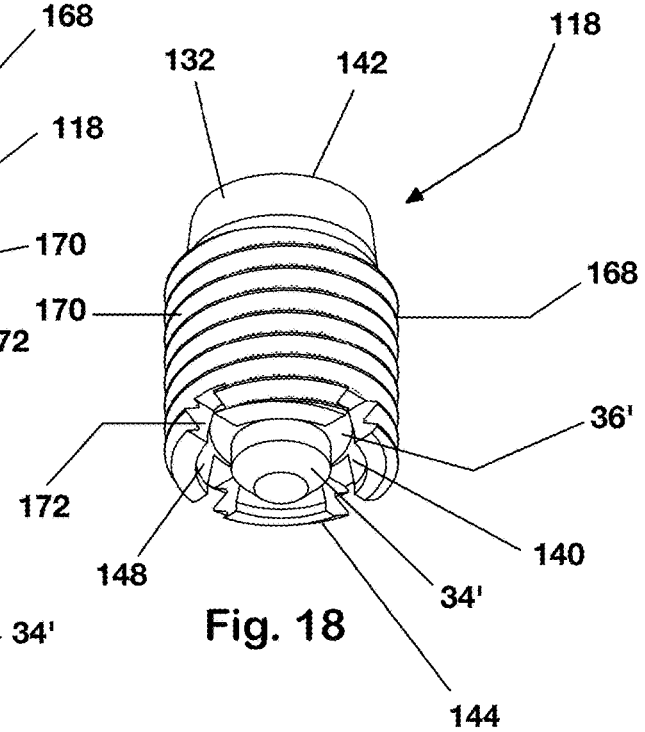
FIG. 18 is a bottom perspective view of the check valve of FIG. 17.
Figure 20:
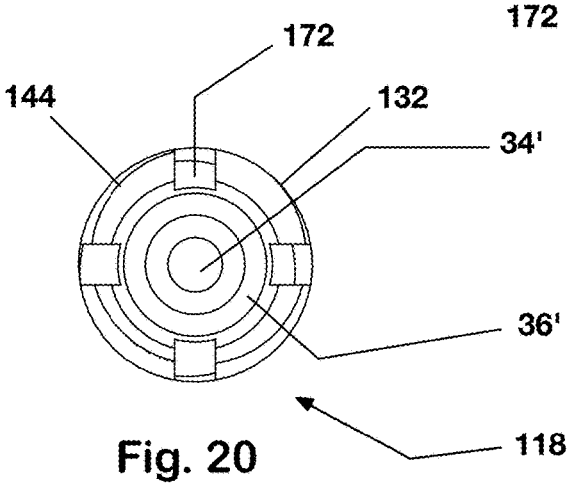
FIG. 20 is a bottom plan view of the check valve of FIGS. 17-19.
Figure 21:
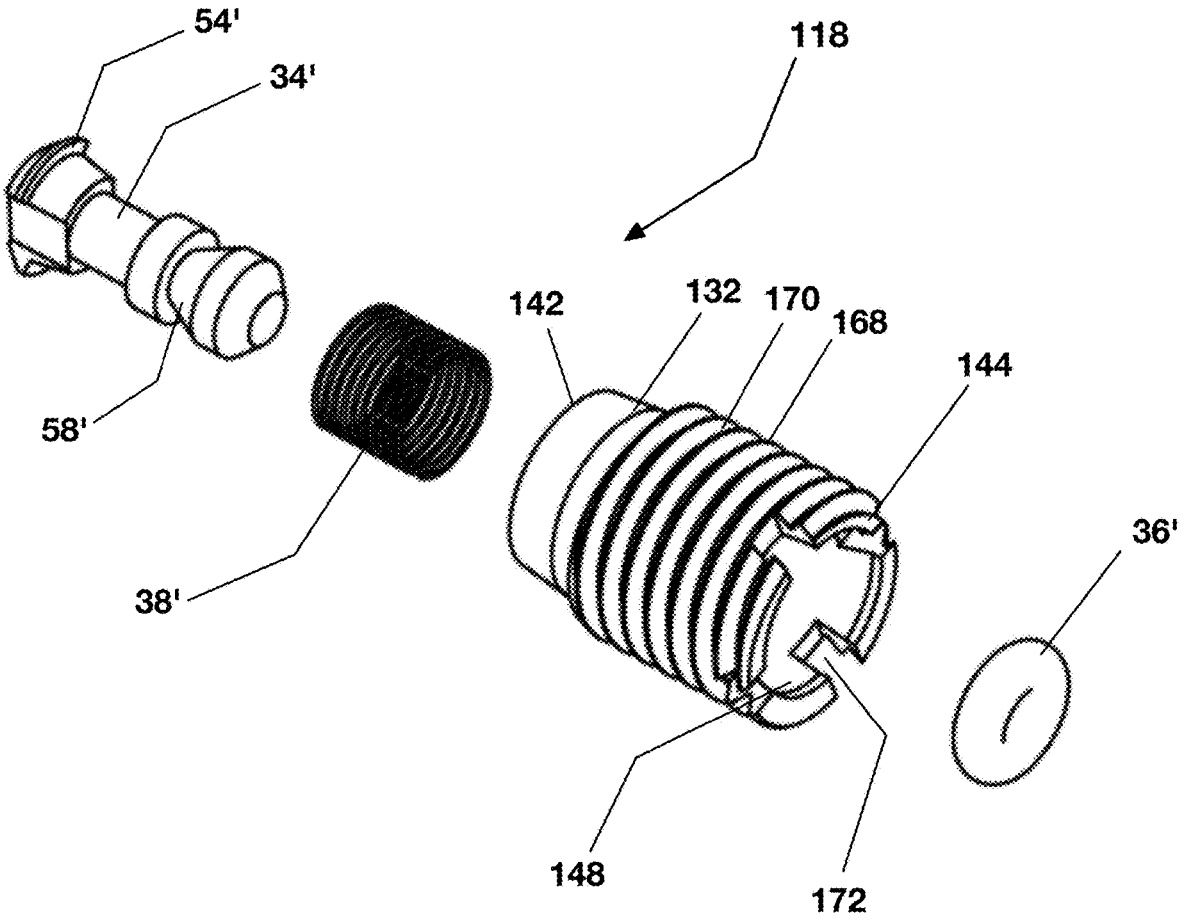
FIG. 21 is an exploded side perspective view of the check valve of FIGS. 17-20.
Figure 22:
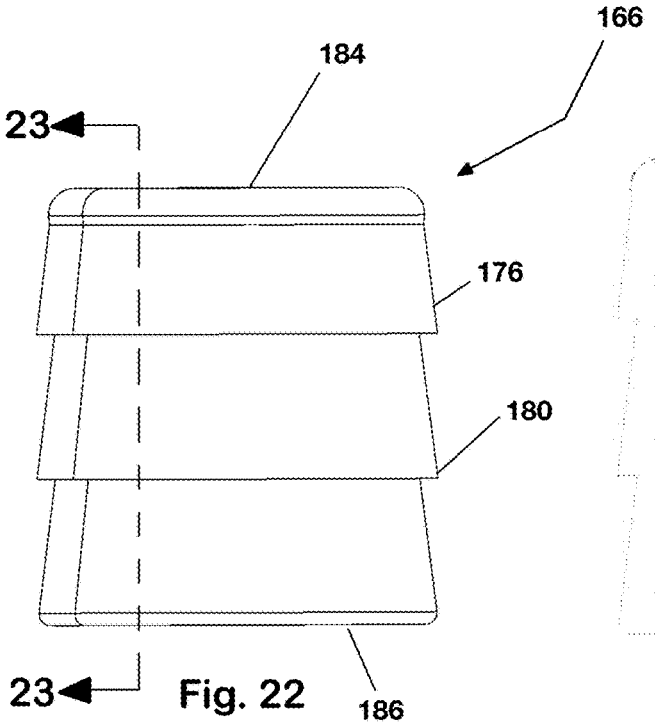
FIG. 22 is a front elevational view of a sleeve of the vacuum release mechanism with the check valve of FIGS. 17-21.
Figure 23:
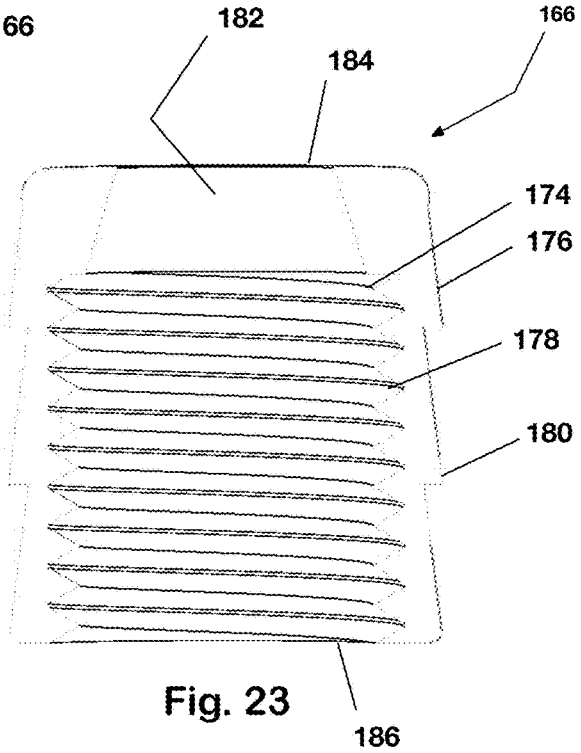
FIG. 23 is a sectional view of the sleeve of FIG. 22 taken along section line 23-23 in FIG. 22.
Figure 24:
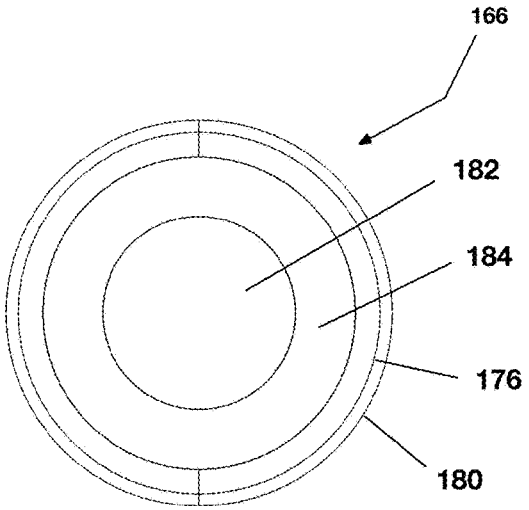
FIG. 24 is a top plan view of the sleeve of FIGS. 22 and 23.
Figure 25:
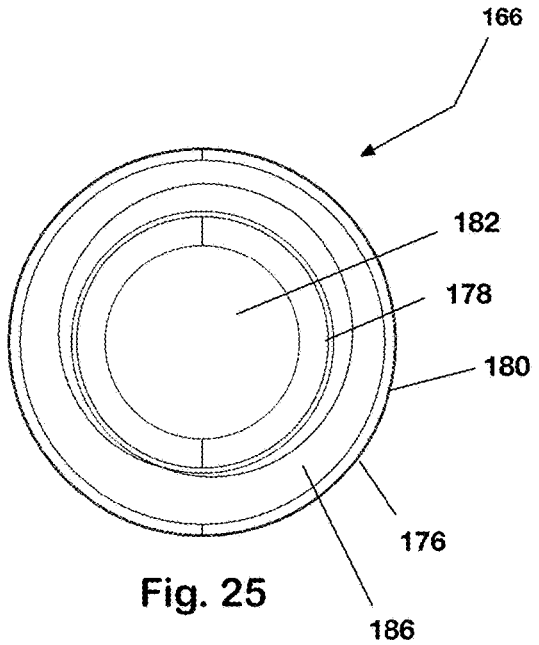
FIG. 25 is a bottom plan view of the sleeve of FIGS. 22-24.
Figure 26:
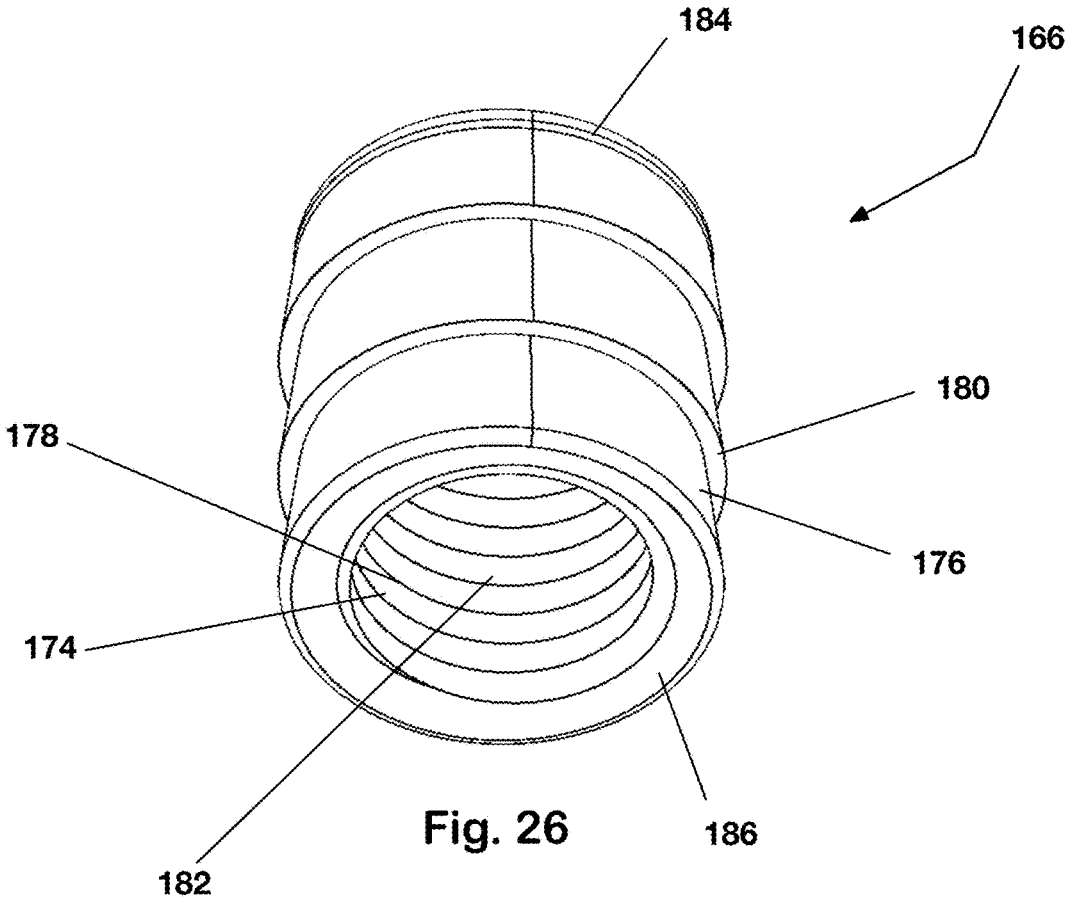
FIG. 26 is a bottom perspective view of the sleeve of FIGS. 22-25.
Figure 27:
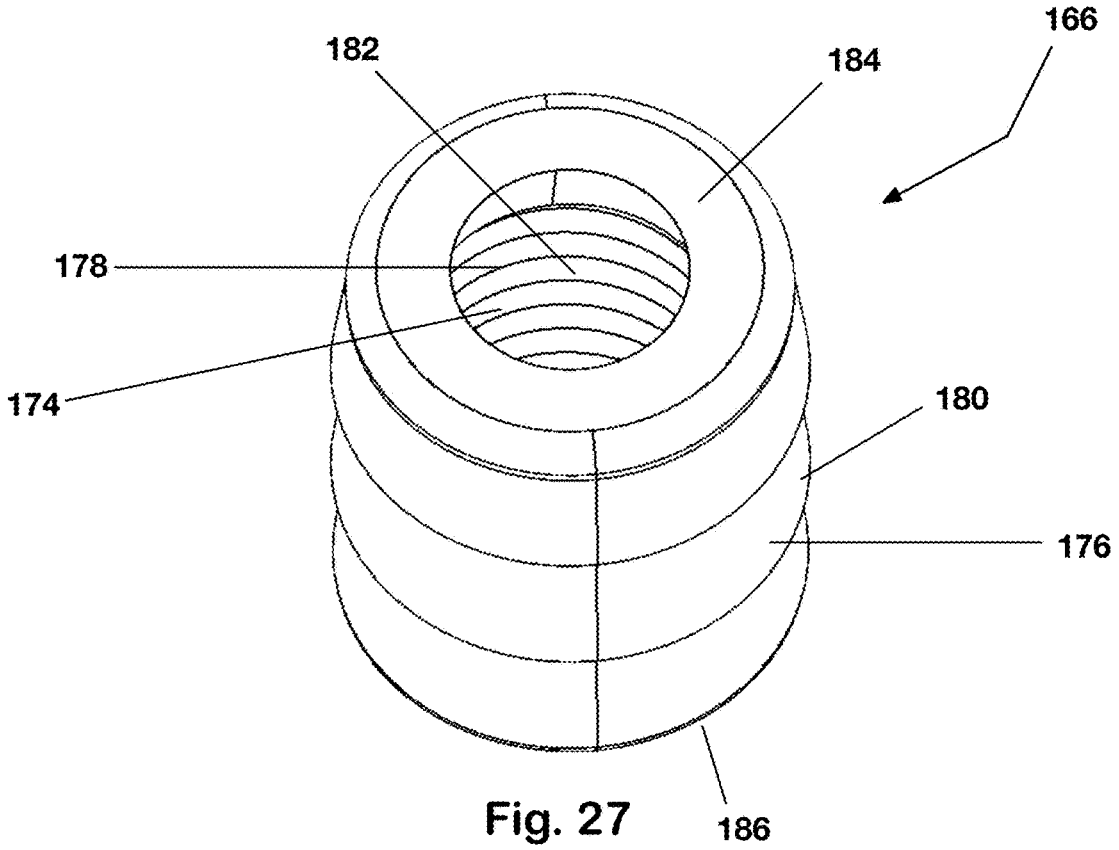
FIG. 27 is a top perspective view of the sleeve of FIGS. 22-26.

An exemplary embodiment of one of the check valves 18 is shown in FIGS. 12-16. The check valve 18 comprises a valve body 32, a movable valve piston 34, a sealing element 36 (e.g., an O-ring), and a biasing element 38 (e.g., a helical spring). As depicted, the valve body 32 may have a generally cylindrical shape with a bore 40 formed therethrough from a first end 42 to a second end 44 of the valve body 32. A seat 46 may be formed on an inner surface 48 of the valve body 32 to perform as a stop for the biasing element 38. One or more barbs 50 may be integrally formed on an outer surface 52 of the valve body 32 to engage the inner surface 28 of the fluid passageway 20 to maintain a position of the check valve 18 therein. The biasing element 38 is biased between a retainer portion 54 of the valve piston 34 and the seat 46 of the valve body 32. The biasing element 38 positions the valve piston 34 in a closed first position, as shown in FIG. 14, causing the sealing element 36 to seal against a valve body sealing surface 56 and a valve piston sealing surface 58. The check valves 18 in the first position militates against a flow of fluid therethrough when the footwear article 2 is unrestrained.

FIGS. 17-21 illustrate a replaceable check valve 118 for a vacuum release mechanism 116 according to another embodiment of the disclosure. The check valve 118 of FIGS. 17-21 is substantially similar to the check valve 18 of FIGS. 12-16, with the primary distinction being the retaining method used to retain the check valves 118 in the fluid passageways 20. Corresponding structural elements in FIGS. 17-21 are identified using reference numbers with a prime symbol ('). For simplicity and brevity, a detailed description of the corresponding structural elements is not repeated herein. New structural elements in FIGS. 17-21 are identified using reference numbers in the one-hundred series.

In this embodiment, the check valve 118 comprises a valve body 132, a movable valve piston 34', a sealing element 36' (e.g., an O-ring), and a biasing element 38' (e.g., a helical spring). As depicted, the valve body 132 may have a generally cylindrical shape with a bore 140 formed therethrough from a first end 142 to a second end 144 of the valve body 132. The valve body 132 may also include one or more slots 172 formed at the second end 144, each slot 172 extending longitudinally into the valve body 132 towards the first end 142. The slots 172 may take any geometric form as desired. As illustrated in FIGS. 17-21, the slots 172 may be generally rectangular as a non-limiting example.

Figure 30:
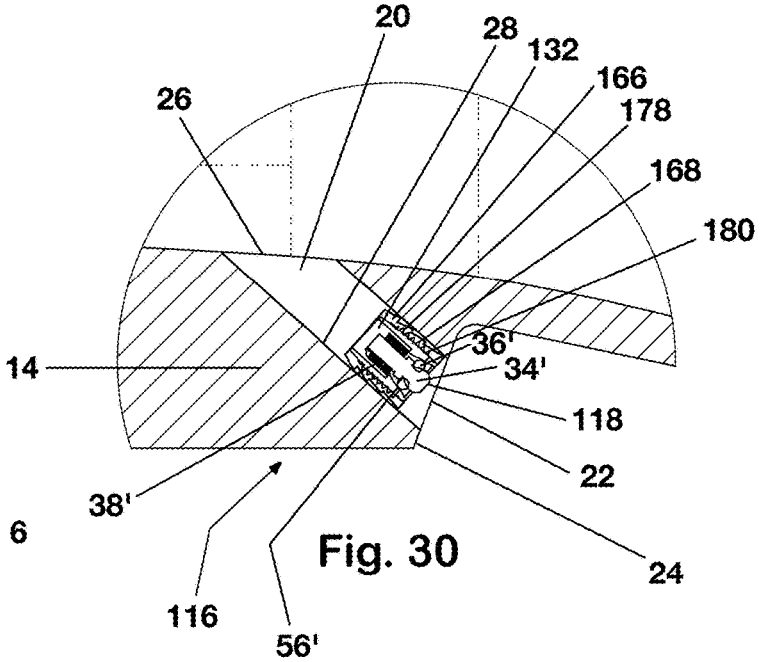
FIG. 30 is an enlarged detailed view of a portion of the footwear article depicted within Circle Area 30 of FIG. 29.
Figure 29:
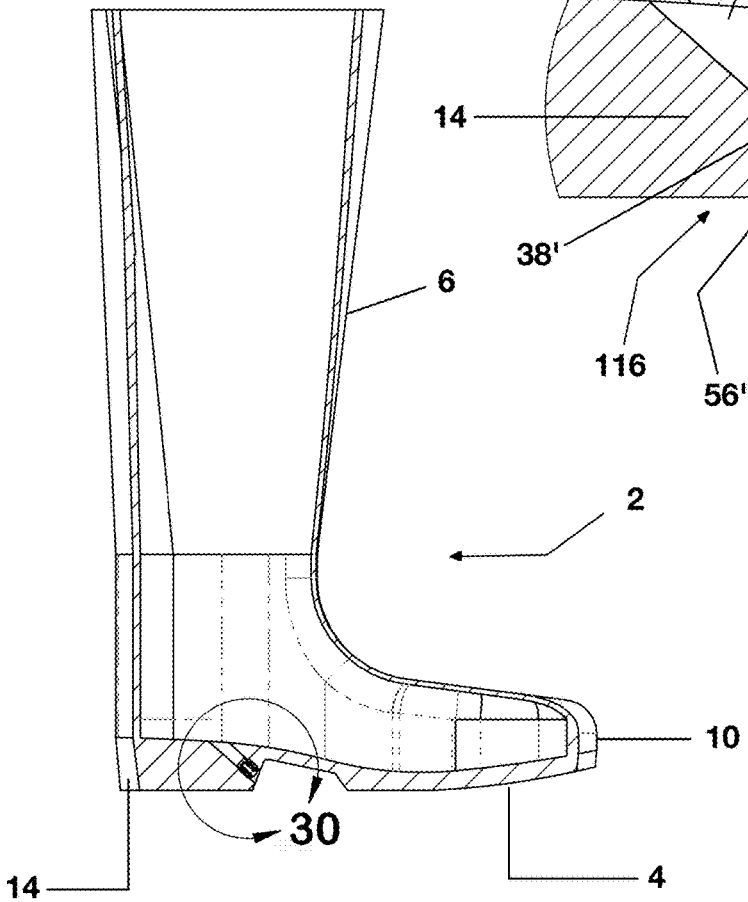
FIG. 29 is a sectional view of the footwear article of FIGS. 1-11 and 28 taken along section line 29-29 in FIG. 28, wherein the lower limb portion of the wearer is disposed in the footwear article and the lower limb portion is in the first position.

A seat (not illustrated) may be formed on an inner surface 148 of the valve body 132 to perform as a stop for the biasing element 38'. The biasing element 38' is biased between a retainer portion 54' of the valve piston 34' and the seat of the valve body 132. The biasing element 38' positions the valve piston 34' in a closed first position, as illustrated in FIGS. 29 and 30, causing the sealing element 36' to seal against a valve body sealing surface 56' and a valve piston sealing surface 58'. The check valve 118 in the first position militates against a flow of fluid therethrough when the footwear article 2 is unrestrained.

FIGS. 22-27 illustrate a sleeve 166 which is provided to retain the check valve 118 within the fluid passageway 20. Preferably, the check valve 118 is removably disposed within the sleeve 166. As illustrated, the sleeve 166 may have a generally cylindrical shape with a bore 182 formed therethrough from a first end 184 to a second end 186 of the sleeve 166. The sleeve 166 also has an inner surface 174 and an outer surface 176. The sleeve 166 may be configured to be releasably coupled with the valve body 132 of the check valve 118. In some embodiments, the sleeve 166 and the valve body 132 of the check valve 118 are releasably coupled by threaded engagement. In this exemplary embodiment, the check valve 118 includes a plurality of external threads 168 integrally formed on an outer surface 170 of the valve body 132. Additionally, the inner surface 174 of the sleeve 166 may include one or more internal threads 178 integrally formed on the inner surface 174 of the sleeve 166. In this embodiment, the internal threads 178 may be formed to engage with the external threads 168 on the outer surface 170 of the valve body 132. It should be understood, however, that the sleeve 166 and the valve body 132 of the check valve 118 may be releasably coupled by any other suitable means and method as desired.

The sleeve 166 is configured to be fixedly secured within the fluid passageway 20. In some embodiments, the outer surface 176 of the sleeve 166 may include one or more projections 180, for example, barbs integrally formed on and extending outwardly from the outer surface 176 of the sleeve 166. The one or more projections 180 may be configured to engage the inner surface 28 of the fluid passageway 20 to maintain a position of the sleeve 166, and therefore the check valve 118, therein. However, it should be understood that the sleeve 166 can be fixedly secured in the fluid passageway 20 by any suitable means and method as desired. In some embodiments, a sealing element (not illustrated) may be provided to form a substantially fluid-tight seal between the at least one sleeve 166 and the inner surface 28 of the at least one fluid passageway 20.

Figure 28:
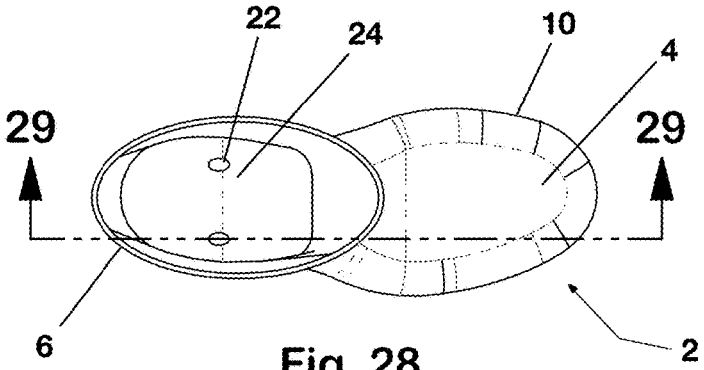
FIG. 28 is a bottom plan view of the footwear article of FIGS. 1-11 including two vacuum release mechanisms, each comprising the check valve of FIGS. 17-21 and the sleeve of FIGS. 22-27.

FIGS. 28-30 further illustrate an exemplary embodiment of the vacuum release mechanism 116 for the footwear article 2 having check valves 118. In this embodiment, the sleeves 166 are placed within the fluid passageways 20, lining the inner surface 28 of the fluid passageways 20. The sleeves 166 are fixedly secured within the fluid passageways 20 through the one or more projections 180 which engage the inner surface 28 of the fluid passageways 20 to maintain the position of the sleeve 166 within the fluid passageways 20. The check valves 118 are also placed within the fluid passageways 20 and are releasably coupled with the sleeves 166. In this embodiment, the external threads 168 disposed on the outer surface 170 of the valve body 132, and therefore the check valves 118, are configured to interact with the internal threads 178 integrally formed on the inner surface 174 of the sleeves 166.

When the threads 168, 178 engage, the check valves 118 are securely retained within the sleeve 166, and therefore within the fluid passageways 20 of the vacuum release mechanism 116. This provides the check valves 118 with a secure fit within the fluid passageways 20 when the external threads 168 of the valve body 132 are used to screw the check valve 118 into the internal threads 178 of the sleeves 166, which is retained in a position within the fluid passageways 20 though the one or more projections 180 which engage the inner surface 28 of the fluid passageways 20.

This embodiment allows for the check valves 118 to be removeable from the sleeves 166, and therefore the fluid passageways 20. This is because the check valves 118 may be disengaged from the sleeves 166 and removed from the fluid passageways 20.

Figure 31:
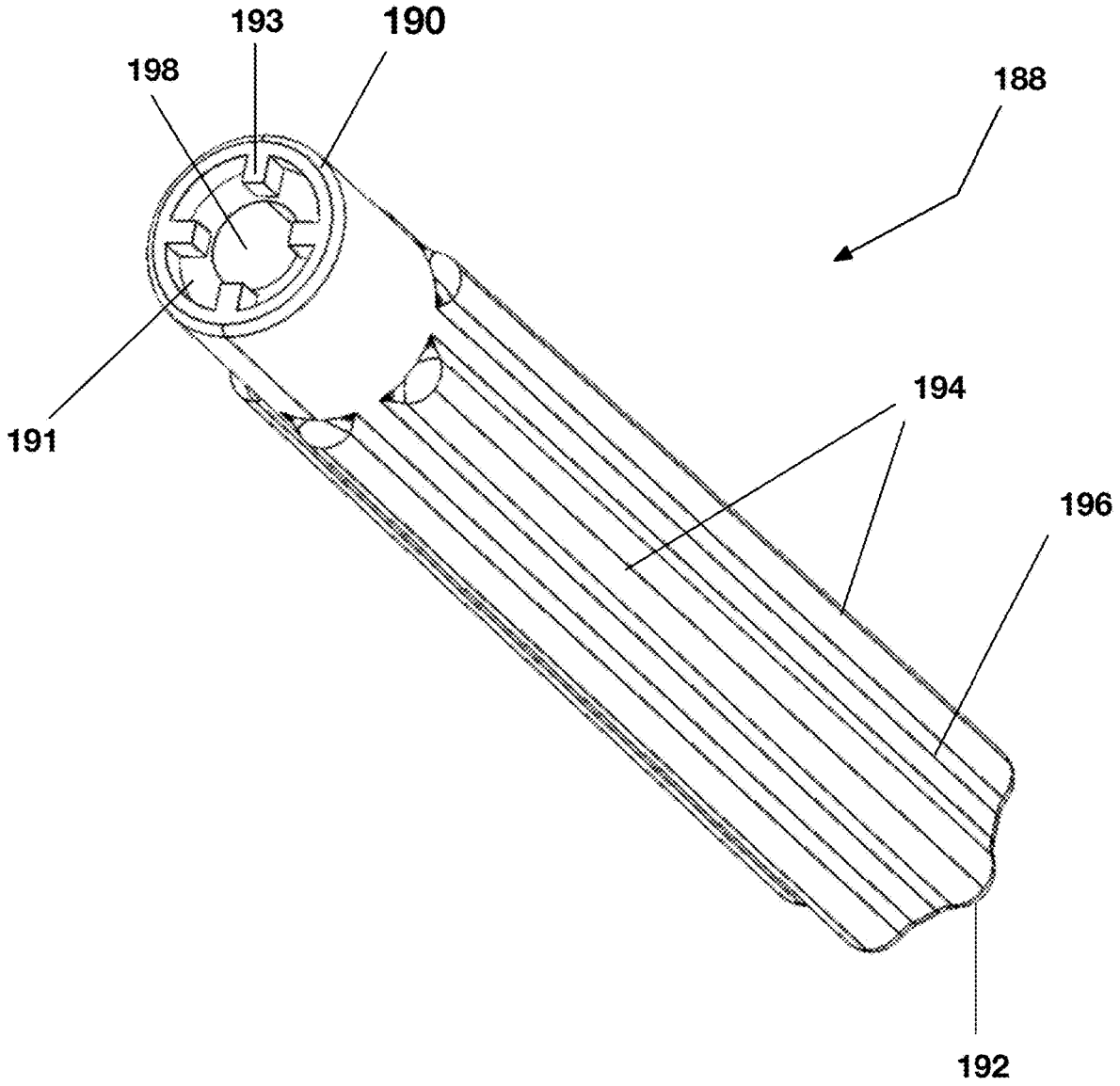
FIG. 31 is a perspective view of a tool for the footwear article of FIGS. 1-11 and 28-30 for installation and removable of the check valve shown in FIGS. 17-21 of the vacuum release mechanism.
Figure 32:
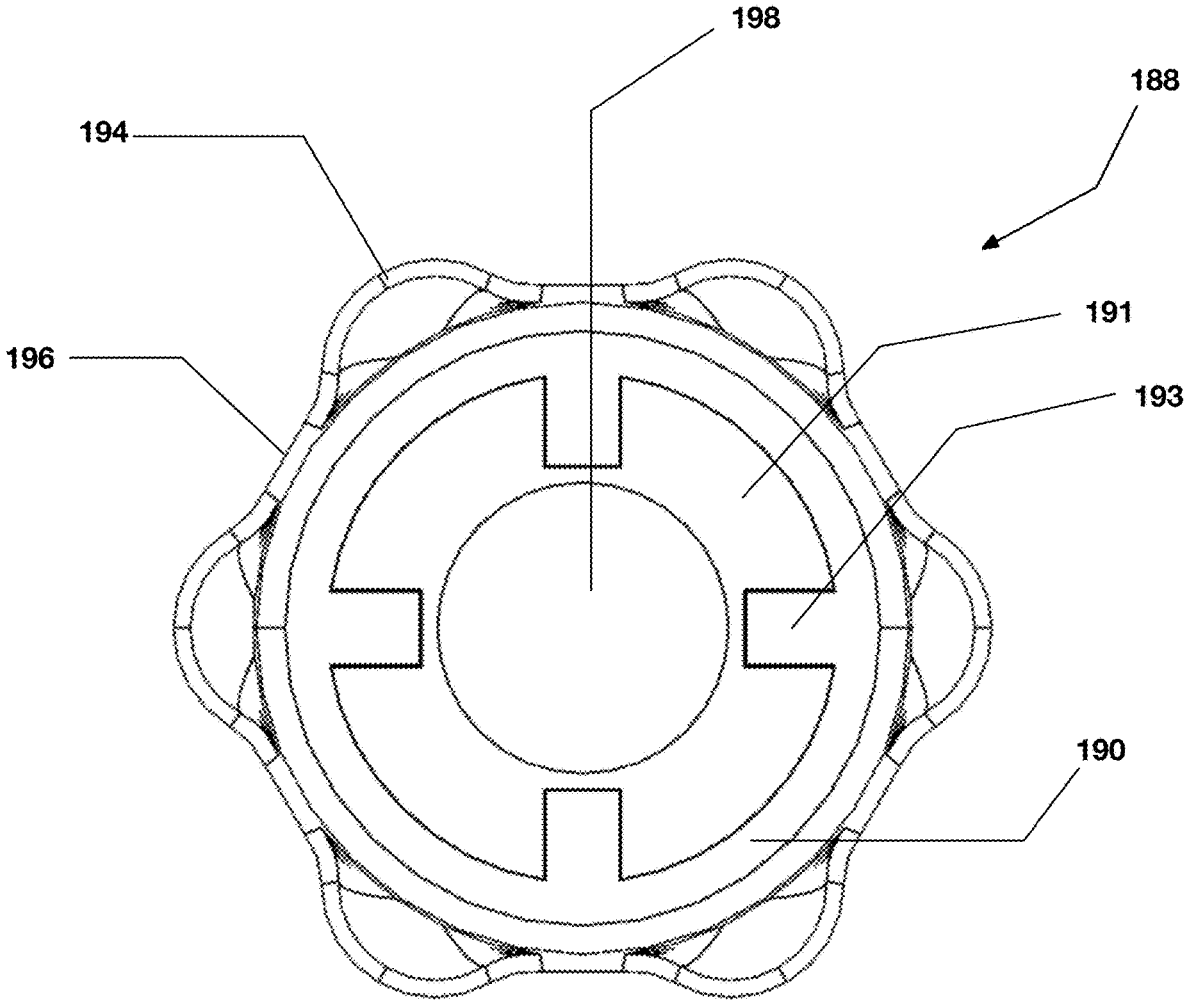
FIG. 32 is a top plan view of the tool of FIG. 31.

FIGS. 31-32 illustrate a tool 188 according to an embodiment of the disclosure which may be used to install and remove the check valves 118 from the sleeves 166. The tool 188 may have any geometric shape as desired. In an exemplary embodiment, and as illustrated in FIGS. 31-32, the tool 188 is generally cylindrical. The tool 188 includes a first end 190 and a second end 192. The tool 188 may also include one or more surface features 194 integrally formed on the outer surface 196 of the tool 188. The one or more surface features 194 (e.g., ribs, grooves, protrusions, etc.) may provide the user of the tool 188 more grip while utilizing the tool 188. The tool 188 may also include a bore 198 formed therethrough from the first end 190 to the second end 192 of the tool 188 to reduce mass and manufacturing costs.

The first end 190 of the tool 188 may include one or more teeth 193 extending radially inwards from an outer circumferential wall formed within the first end 190 of the tool 188. As shown, each of the teeth 193 may be spaced apart from an adjacent one of the teeth 193 by a gap 191. Although an annular array of the teeth 193 is shown, it is understood that any number, shape, or configuration of teeth 193 may be employed. It is also understood that the tool 188 may employ other means and methods to install and remove the check valve 118 if desired.

The teeth 193 may be configured to correspond with and/or be substantially aligned with the slots 172 formed at the second end 144 of the valve body 132. This allows for the check valves 118 to be removable and replaceable while the sleeve 166 remains in position within the fluid passageways 20.

To remove the check valve 118 from the sleeve 166 while the sleeve 166 remains in position within the fluid passageway 20, the first end 190 of the tool 188 must be inserted into the fluid passageway 20, and more specifically the teeth 193 are received into the slots 172 of the second end 144 of the valve body 132. This creates a temporary engagement between the slots 172 of the check valve 118 and the teeth 193 of the tool 188, allowing the tool 188 to rotate the check valve 118 in either a clockwise or a counterclockwise direction as desired. Therefore, the tool 188 may be used to disengage the check valve 118 from the sleeve 166 and may remove the check valve 118 from the fluid passageway 20 as desired. The tool 188 may also be used to replace the check valve 118 within the fluid passageway 20 by using the tool 188 to insert the check valve 118 back into the fluid passageway 20 and rotate the check valve 118, thereby engaging the check valve 118 back into the sleeve 166. This reestablishes the secure fit of the check valve 118 within the sleeve 20, and therefore the fluid passageway 20.

The slots 172 of the check valve 118 and the teeth 193 of the tool 188, as well as the external threads 168 of the valve body 132 and the internal threads 178 of the sleeves 166, allow for the check valves 118 to be removeable and replaceable. This is particularly useful in situations where one of the check valves 118 fail or becomes damaged. If this occurs, then only the check valve 118 requires replacement as opposed to the entire footwear article 2 to keep the vacuum release mechanism 16 working properly.

As a vacuum is created in a low pressure region under the footwear article 2 adjacent the end openings 22 of the check valves 18, 118, a fluid from a high atmospheric pressure region within the interior 12 of the footwear article 2 and/or a vacuum force acting on the footwear article 2 overcomes a force of the biasing element 38 and urges the valve piston 34 away from the first end 42 and towards the second end 44 thereof so that the check valve 18, 118 is in an open second position. When the check valve 18, 118 is in the second position, the sealing element 36 is no longer sealing engaged with at least one of the valve body sealing surface 56 and the valve piston sealing surface 58 and thereby permits the flow of fluid therethrough when the footwear article 2 is restrained by a vacuum. Thus, pressure may be equalized across the check valve 18, 118.

Figure 10:
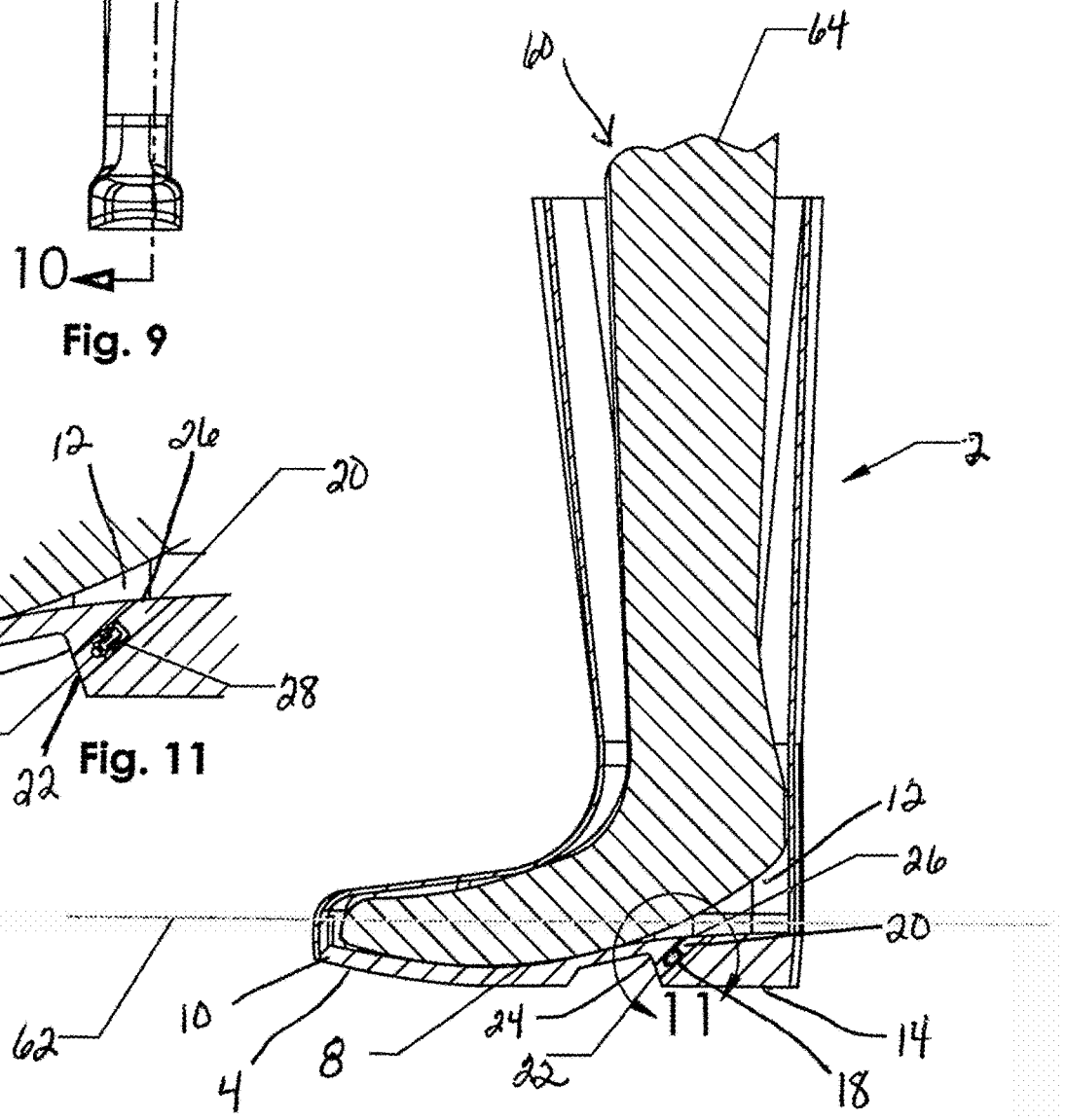
FIG. 10 is a fragmentary section view of the footwear article of FIGS. 1-9 taken along section line 10-10 of FIG. 9, wherein the lower limb portion of the wearer is disposed in the footwear article and the lower limb portion is in the second position.
Figure 12:
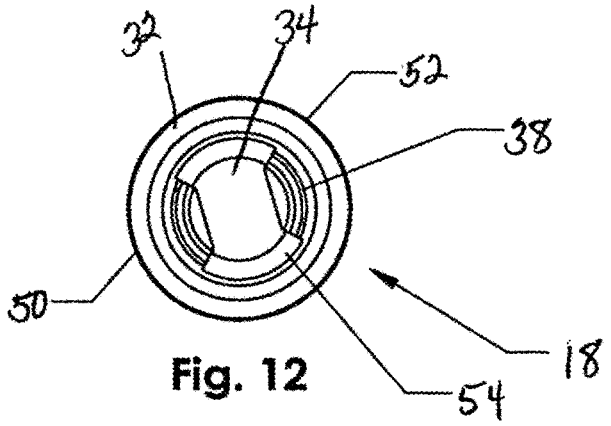
FIG. 12 is a top plan view of a check valve of the vacuum release mechanism of the footwear article of FIGS. 1-11.
Figure 13:
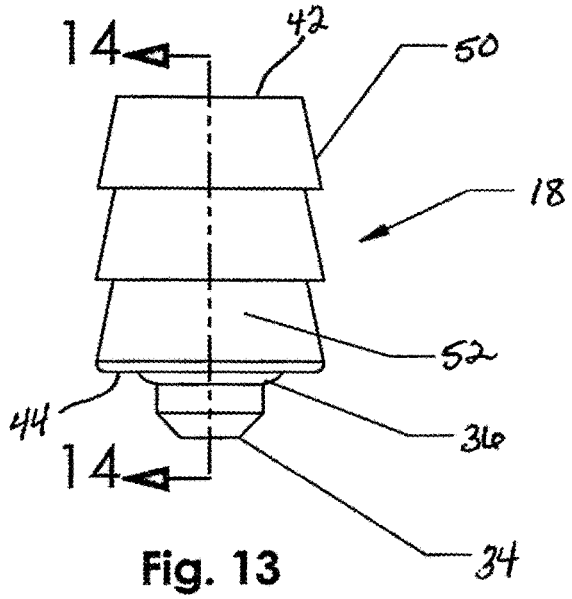
FIG. 13 is a side elevational view of the check valve of FIG. 12.

As a wearer 60 (depicted in FIGS. 8 and 10) takes a step and the footwear article 2 is placed in a viscous material at an approximate fluid level 62 relative to footwear article 2, a vacuum is created under the footwear article 2, causing resistance to a leg 64 of the wearer 60. As the wearer 60 lifts the leg 64 to take another step, the vacuum would typically not allow the footwear article 2 to be easily pulled from the viscous material. However, the vacuum release mechanism 16 of the footwear article 2 allows the footwear article 2 to be easily removed from the viscous material. In particular, the check valves 18, 118 allow the fluid from the high atmospheric pressure region within the interior 12 of the footwear article 2 to flow through the fluid passageways 20 to the low atmospheric pressure region under the sole 4 and/or the heel 14 to equalize the pressure difference therebetween and thereby eliminate the vacuum created in the low atmospheric pressure region. Referring to FIG. 10, as the wearer 60 takes a step, the leg 64 is lifted to allow the end openings 26 of the fluid passageways 20 enough space for the fluid at atmospheric air pressure to reach the end openings 24 of the fluid passageways 20, thereby eliminating the low pressure region creating the vacuum under the sole 4 and/or the heel 14 of the footwear article 2.

Example embodiments are provided so that this disclosure will be thorough, and willfully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar result.

ITEM LIST

2 Footwear article
4 Sole
6 Upper
8 Insole
10 Outsole
12 Interior
14 Heel
16, 116 Vacuum release mechanism
18, 118 Check valves
20 Fluid passageways
22 End openings of fluid passageways
24 Face of heel
26 End openings of fluid passageways
28 Inner surface of fluid passageway
32 Valve body
34, 34' Valve piston
36, 36' Sealing element
38, 38' Biasing element
40 Bore of valve body
42 First end of valve body
44 Second end valve body
46 Seat of valve body
48 Inner surface of valve body

50 Barb of valve body
52 Outer surface of valve body
54, 54' Retainer portion of valve piston
56, 56' Valve body sealing surface
58, 58' Valve piston sealing surface
60 Wearer
62 Approximate fluid level
64 Leg of wearer
132 Valve body
140 Bore of valve body
142 First end of valve body
144 Second end of valve body
166 Sleeve
168 External threads of valve body
170 Outer surface of valve body
172 Slots of valve body
174 Inner surface of sleeve
176 Outer surface of sleeve
178 Internal threads of sleeve
180 Projections of sleeve
182 Bore of sleeve
184 First end of sleeve
186 Second end of sleeve
188 Tool
190 First end of tool
191 Gap of tool
192 Second end of tool
193 Teeth of tool
194 Surface features of tool
196 Outer surface of tool
198 Bore of tool

What is claimed is:

1. A vacuum release mechanism for a footwear article, comprising:

at least one sleeve fixedly secured within at least one passageway formed in a sole of the footwear article, the at least one sleeve having an outer surface including one or more barbs integrally formed on and extending radially outwardly from the outer surface of the at least one sleeve along a length thereof, the one or more barbs configured to frictionally engage an inner surface of the at least one passageway by interference fit to fixedly retain the at least one sleeve therein; and at least one replaceable check valve removably disposed within the at least one sleeve, wherein the at least one replaceable check valve is releasably coupled to the at least one sleeve by threaded engagement such that the at least one replaceable check valve is removable from the at least one sleeve while the at least one sleeve remains fixedly secured within the at least one passageway by the one or more barbs.

2. The vacuum release mechanism of claim 1, wherein the at least one replaceable check valve is a spring-type check valve, comprising:

a valve body;

a movable valve piston disposed within the valve body, the valve piston positionable between a closed position to militate against a flow of fluid through the at least one passageway and an open position to permit the flow of fluid through the at least one passageway; and a biasing element configured to urge the movable valve piston towards the closed position.

3. The vacuum release mechanism of claim 2, wherein the valve body is configured to cooperate with a tool for installation and removal from the at least one sleeve.

4. The vacuum release mechanism of claim 2, wherein the valve body includes one or more slots configured to cooperate with one or more teeth of a tool for installation and removal from the at least one sleeve.

5. A footwear article, comprising:

a sole including an insole, an outsole, and a heel;

an upper coupled to the sole, wherein the insole and the upper defines an interior of the footwear article;

at least one passageway formed in the sole, the at least one passageway fluidly connects an exterior environment with the interior of the footwear article; and at least one vacuum release mechanism disposed within the at least one passageway of the sole, comprising:

at least one sleeve fixedly secured within at least one passageway formed in the sole, the at least one sleeve having an outer surface including one or more barbs integrally formed on and extending radially outwardly from the outer surface of the at least one sleeve along a length thereof, the one or more barbs configured to frictionally engage an inner surface of the at least one passageway by interference fit to fixedly retain the at least one sleeve therein; and at least one replaceable check valve removably disposed within the at least one sleeve, wherein the at least one replaceable check valve is releasably coupled to the at least one sleeve by threaded engagement such that the at least one replaceable check valve is removable from the at least one sleeve while the at least one sleeve remains fixedly secured within the at least one passageway by the one or more barbs.

6. The footwear article of claim 5, wherein the at least one replaceable check valve is a spring-type check valve, comprising:

a valve body;

a movable valve piston disposed within the valve body, the valve piston positionable between a closed position to militate against a flow of fluid through the at least one passageway and an open position to permit the flow of fluid through the at least one passageway; and a biasing element configured to urge the movable valve piston towards the closed position.

7. The footwear article of claim 6, wherein the at least one check valve is maintained in the closed position when the footwear article is not subjected to a vacuum force, and wherein the at least one check valve transitions to the open position when the vacuum force acting on the at least one check valve exceeds a biasing force exerted by the biasing element on the movable valve piston so that the flow of fluid through the at least one passageway is permitted when the footwear article is restrained by a vacuum.

8. The footwear article of claim 5, wherein the footwear article forms part of a waterproof garment.

9. The footwear article of claim 5, wherein a side face of the heel intersects and is formed at an angle relative to an outer contact surface of the outsole, and wherein a first end opening of the at least one passageway is formed in the side face of the heel and a second end opening of the at least one passageway is formed in the insole.

10. The footwear article of claim 9, wherein the first end opening of the at least one fluid passageway is oblique to the outsole of the footwear article.

11. The footwear article of claim 9, wherein the second end opening of the at least one fluid passageway is relatively coplanar with an interior surface of the insole of the footwear article.

12. The footwear article of claim 5, wherein an entirety of the at least one fluid passageway is formed in the sole of the footwear article.

13. The footwear article of claim 5, wherein the at least one fluid passageway is formed at an angle through the sole of the footwear article.

14. The footwear article of claim 5, wherein the at least one fluid passageway forms a linear flow path through the sole of the footwear article.

15. The footwear article of claim 5, wherein a plurality of vacuum release mechanisms is disposed in a plurality of fluid passageways formed in the sole of the footwear article, and wherein each of the fluid passageways is separate and fluidly disconnected from one another.

16. The footwear article of claim 5, wherein the sole of the footwear article is produced from a self-sealing material that forms a substantially fluid-tight seal between the at least one sleeve and the inner surface of the at least one fluid passageway.

17. The footwear article of claim 5, further comprising a sealing element to form a substantially fluid-tight seal between the at least one sleeve and the inner surface of the at least one fluid passageway.

18. A footwear article, comprising:

a sole including an insole, an outsole, and a heel having a side face, wherein the side face of the heel intersects and is formed at an angle relative to an outer contact surface of the outsole;

an upper coupled to the sole, wherein the insole and the upper defines an interior of the footwear article;

at least one passageway formed in the sole, the at least one passageway fluidly connects an exterior environment with the interior of the footwear article, wherein a first end opening of the at least one passageway is formed in the side face of the heel and a second end opening of the at least one passageway is formed in the insole; and at least one vacuum release mechanism disposed within the at least one passageway of the sole, comprising:

at least one sleeve fixedly secured within the at least one passageway formed in the sole of the footwear article, the at least one sleeve having an outer surface including one or more barbs integrally formed on and extending radially outwardly from the outer surface of the at least one sleeve along a length thereof, the one or more barbs configured to frictionally engage an inner surface of the at least one passageway by interference fit to fixedly retain the at least one sleeve therein; and at least one replaceable check valve removably disposed within the at least one sleeve, wherein the at least one replaceable check valve is a spring-type check valve, comprising:

a valve body;

a movable valve piston disposed within the valve body, the valve piston positionable between a closed position to militate against a flow of fluid through the at least one passageway and an open position to permit the flow of fluid through the at least one passageway; and a biasing element configured to urge the movable valve piston towards the closed position;

wherein the at least one replaceable check valve is releasably coupled to the at least one sleeve by threaded engagement such that the at least one replaceable check valve is removable from the at least one sleeve while the at least one sleeve remains fixedly secured within the at least one passageway by the one or more barbs.

* * * * *